US010350469B2

(12) United States Patent
Serrano et al.

(10) Patent No.: US 10,350,469 B2
(45) Date of Patent: Jul. 16, 2019

(54) VARIABLE LOFT GOLF CLUBS AND METHODS TO MANUFACTURE VARIABLE LOFT GOLF CLUBS

(71) Applicant: KARSTEN MANUFACTURING CORPORATION, Phoenix, AZ (US)

(72) Inventors: Anthony D. Serrano, Anthem, AZ (US); David A. Higdon, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 70 days.

(21) Appl. No.: 14/322,256

(22) Filed: Jul. 2, 2014

(65) Prior Publication Data

US 2015/0018122 A1 Jan. 15, 2015

Related U.S. Application Data

(60) Provisional application No. 61/845,556, filed on Jul. 12, 2013.

(51) Int. Cl.

| | |
|---|---|
| ***A63B 53/06*** | (2015.01) |
| ***A63B 60/00*** | (2015.01) |
| *A63B 53/04* | (2015.01) |

(52) U.S. Cl.

CPC ..... *A63B 53/065* (2013.01); *A63B 53/06* (2013.01); *A63B 60/00* (2015.10); *A63B 2053/042* (2013.01); *A63B 2053/0416* (2013.01); *A63B 2053/0445* (2013.01); *A63B 2053/0458* (2013.01); *A63B 2053/0462* (2013.01); *A63B 2053/0491* (2013.01); *Y10T 29/49* (2015.01)

(58) Field of Classification Search

CPC ..... A63B 2053/0416; A63B 2053/042; A63B 2053/0445; A63B 2053/0462; A63B 2053/0458; A63B 2053/0491; A63B 53/06; A63B 53/065

USPC ..... 473/341, 342, 349, 331, 334, 335, 336, 473/340

See application file for complete search history.

(56) References Cited

U.S. PATENT DOCUMENTS

| | | | | |
|---|---|---|---|---|
| 1,543,691 A | | 6/1925 | Beat | |
| 3,368,812 A | * | 2/1968 | Baldwin, Sr. ..... | A63B 53/04 473/288 |
| 3,652,094 A | | 3/1972 | Glover | |
| 3,692,306 A | | 9/1972 | Glover | |
| 4,213,613 A | | 7/1980 | Nygren | |
| 4,618,149 A | | 10/1986 | Maxel | |
| 5,299,807 A | * | 4/1994 | Hutin ..... | A63B 53/04 473/329 |
| 5,863,257 A | * | 1/1999 | Busnardo ..... | A63B 53/02 473/246 |
| 6,203,443 B1 | | 3/2001 | Britton | |
| 7,160,203 B2 | * | 1/2007 | Bonneau ..... | A63B 53/0487 473/334 |

(Continued)

*Primary Examiner* — Benjamin Layno

(57) ABSTRACT

A golf club head includes a face portion, a first faceplate configured to be removably attached to the face portion, a second faceplate configured to be removably attached to the face portion, the second face plate having a different configuration than the first faceplate, and a first fastener and a second fastener configured to attach the first faceplate or the second faceplate to the face portion, each fastener having an indicator configured to indicate a weight associated with the fastener.

22 Claims, 4 Drawing Sheets

(56) References Cited

U.S. PATENT DOCUMENTS

| | | | | |
|---|---|---|---|---|
| 7,341,527 | B1 * | 3/2008 | Fisher | A63B 53/0487<br>473/251 |
| 7,413,517 | B2 | 8/2008 | Butler, Jr. et al. | |
| 7,563,172 | B2 | 7/2009 | Mansfield | |
| 2004/0009829 | A1 * | 1/2004 | Kapilow | A63B 53/04<br>473/342 |
| 2005/0022191 | A1 * | 1/2005 | Bonaventure | G06F 8/445<br>718/100 |
| 2005/0221911 | A1 * | 10/2005 | Beach | A63B 53/0466<br>473/338 |
| 2007/0184915 | A1 * | 8/2007 | Mansfield | A63B 53/0487<br>473/340 |
| 2010/0113181 | A1 * | 5/2010 | Lindsay | A63B 53/04<br>473/332 |
| 2011/0028238 | A1 * | 2/2011 | Boyd | A63B 53/04<br>473/342 |
| 2012/0135819 | A1 * | 5/2012 | Uetz | A63B 53/0466<br>473/331 |

* cited by examiner

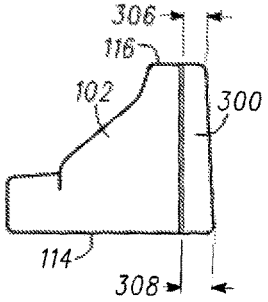
Fig. 7
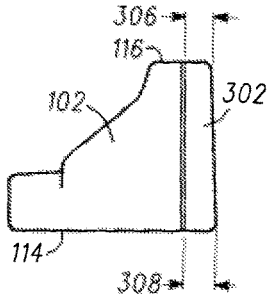
Fig. 8
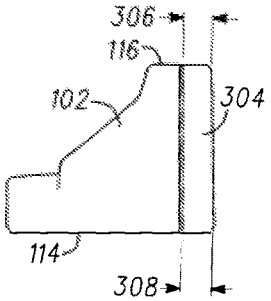
Fig. 9
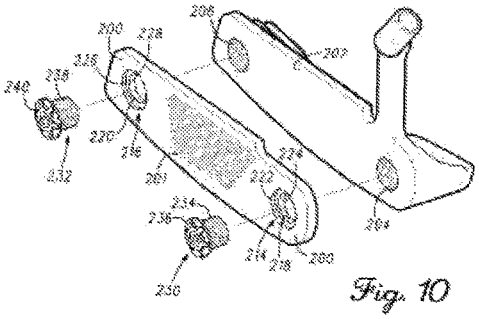
Fig. 10
Fig. 10B
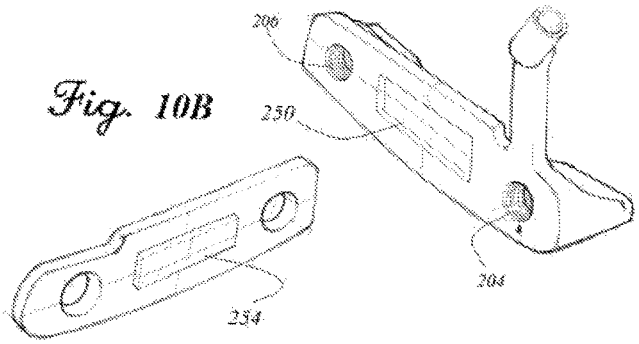

VARIABLE LOFT GOLF CLUBS AND METHODS TO MANUFACTURE VARIABLE LOFT GOLF CLUBS

RELATED APPLICATION

The present application claims priority from U.S. Provisional Patent Application Ser. No. 61/845,556, filed Jul. 12, 2013, the disclosure of which is incorporated by reference.

FIELD

The present application generally relates to golf clubs, and more particularly, to variable loft golf clubs and methods to manufacture variable loft golf clubs.

BACKGROUND

Golf clubs may be fitted to an individual based on the type of golf club, the physical characteristics of the individual and/or the play style of the individual. For example, an individual may wish to play with a putter that has a certain loft angle. In another example, an individual may wish to play with a putter that has a certain weight distribution from the heel portion of the putter to the toe portion of the putter.

BRIEF DESCRIPTION OF THE DRAWINGS

FIGS. 7-9 depict side views of a golf club having variable loft angles according to one embodiment.

FIG. 10 is an exploded view of the head of the golf club of FIGS. 4-6.

DESCRIPTION

In general, variable loft golf clubs and methods to manufacture variable loft golf clubs are described herein. Golf equipment related to the methods, apparatus, and/or articles of manufacture described herein may be conforming or non-conforming to the rules of golf at any particular time. Further, the figures provided herein are for illustrative purposes, and one or more of the figures may not be depicted to scale. The apparatus, methods, and articles of manufacture described herein are not limited in this regard.

Figure 1:
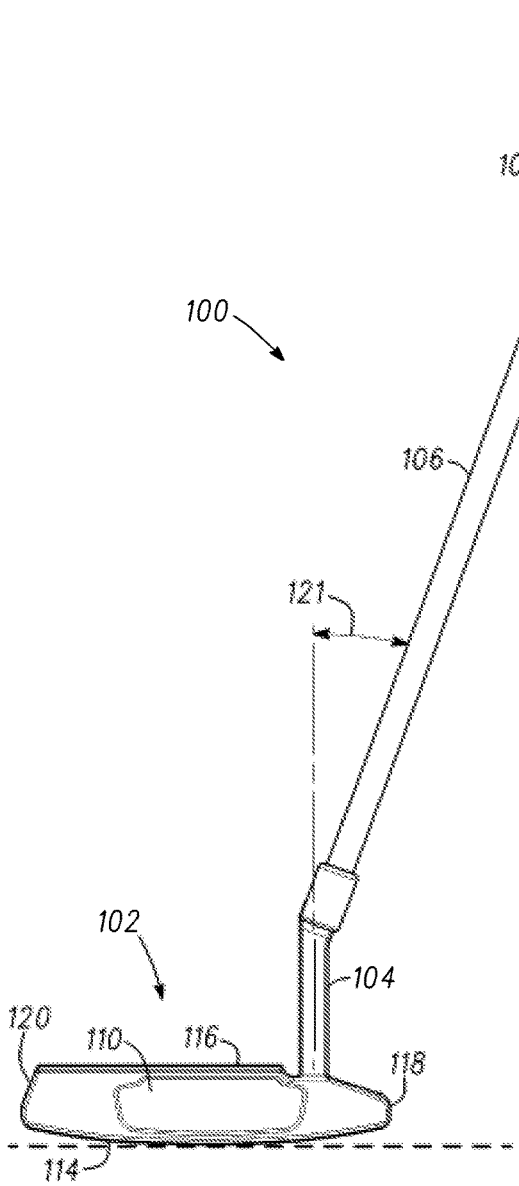
FIG. 1 shows an exemplary golf club.
Figure 2:
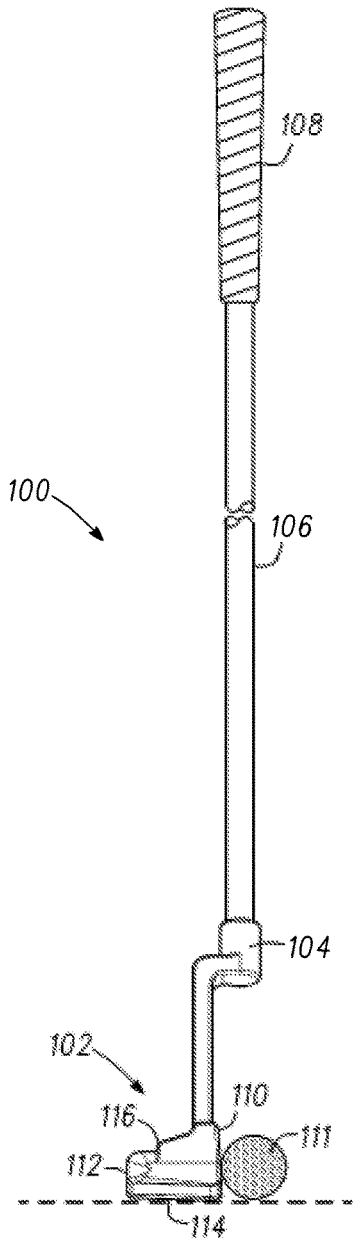
FIG. 2 shows an exemplary golf club.
Figure 3:
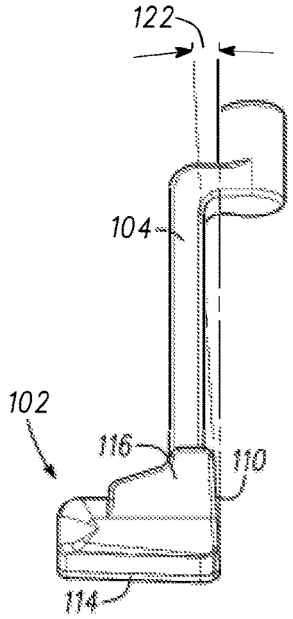
FIG. 3 shows an exemplary golf club.
Figure 4:
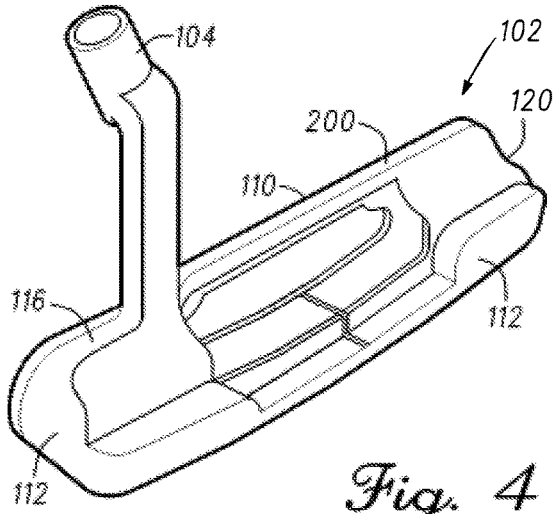
FIG. 4 depicts a perspective view of a rear portion of a head of a golf club according to one embodiment.
Figure 5:
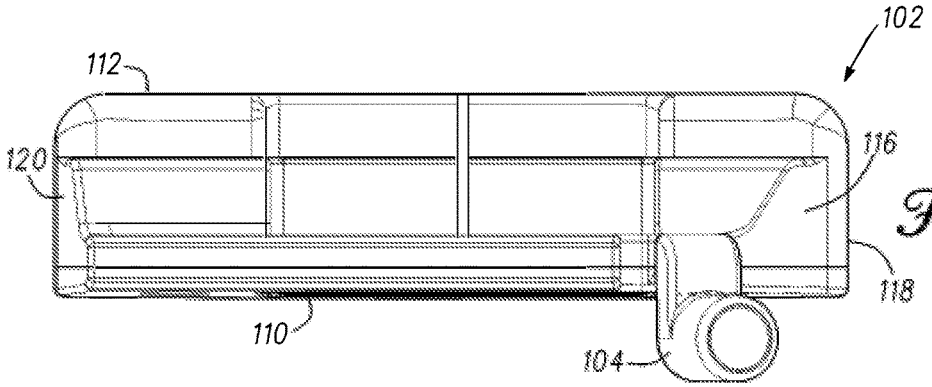
FIG. 5 depicts a top view of the head of the golf club of FIG. 1.
Figure 6:
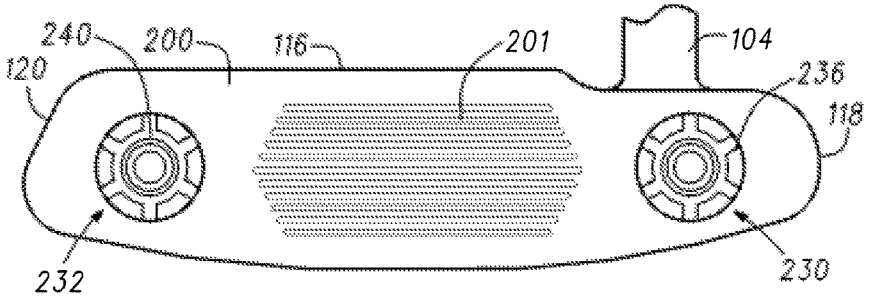
FIG. 6 depicts a front view of the head of the golf club of FIG. 1.

Referring to FIGS. 1-3, a golf club 100 according to one example is shown. The golf club 100 includes a club head 102 that is coupled to a shaft 106. The club head 102 may be connected directly to the shaft 106. In the examples of FIGS. 1-3, the club head 102 is connected to the shaft 106 with a hosel 104 that may be a one-piece part with the club head 102 or a separate part that is connected to the club head 102. The shaft 106 is connected to the hosel 104. The shaft 106 may include a grip 108 by which an individual can hold and use the golf club 100 to strike a golf ball 111 with a face portion 110 of the club head 102. The golf club 100 may described herein and shown in the drawings to be a putter-type golf club. However, the disclosed apparatus, methods, and articles of manufacture are not limited to putters and may be applicable other types of golf clubs such as driver-type golf clubs, fairway wood-type golf clubs, hybrid-type golf clubs, and iron-type golf clubs.

The face portion 110 provides a surface for striking a golf ball 111. The club head 102 includes a back portion 112, a sole portion 114, a top rail portion 116, a heel portion 118, and a toe portion 120. The back portion 112 may be formed opposite the face portion 110 with the sole portion 114 extending under the club head 102 between the back portion 112 and the face portion 110, and the top rail portion 116 extending on top of the golf club head 102 between the back portion 112 and the face portion 110. The heel portion 118 of the golf club head 102 may be defined by the end portion of the golf club head 102 that is near the hosel 104. The toe portion 120 of the golf club head 102 may be defined by the end portion of the golf club head 102 that is opposite to the heel portion 118. Although the golf club head 100 may conform to rules and/or standards of golf defined by various golf standard organizations, governing bodies, and/or rule establishing entities, the apparatus, articles of manufacture, and methods described herein are not limited in this regard.

Referring to FIG. 1, a lie angle 121 of the golf club 100 may be defined by the angle between the shaft 106 and the vertical when the club head 102 is generally horizontally oriented. Referring to FIG. 3, a loft angle 122 may be defined as the angle between the face portion 110 of the club head 102 and the club shaft 106 when the club shaft 106 is generally vertical, i.e., forms a generally 90° angle with the ground.

Referring to FIGS. 4-6 and 10, the face portion 110 may include a faceplate 200 that is removable from the club head 102. The faceplate 200 may include a plurality of grooves 201 (shown in FIGS. 6 and 10). The club head 102 includes a front surface 202 (shown in FIG. 10) onto which the faceplate 200 may be removably attached. The club head 102 further includes two threaded holes 204 and 206 that extend from the front surface 202 toward the back portion 112 of the club head 102. The holes 204 and 206 may be through holes or blind holes. In the disclosed examples, the holes 204 and 206 are blind holes.

The faceplate 200 also includes two holes 214 and 216 that extend through the thickness of the faceplate 200. The threaded hole 204 is located on the front surface 202 and the hole 214 is located on the faceplate 200 such that when the faceplate 200 is generally placed on and aligned with the front surface 202, the threaded hole 204 and the hole 214 are generally aligned and substantially coaxial. Similarly, the threaded hole 206 is located on the front surface 202 and the hole 216 is located the faceplate 200 such that when the faceplate 200 is generally placed on and aligned with the front surface 202, the threaded hole 206 and the hole 216 are generally aligned and substantially coaxial. Accordingly, proper alignment of the faceplate 200 on the front surface 202 for mounting the faceplate 200 on the front surface 202 may include aligning the threaded holes 204 and 206 with the holes 214 and 216, respectively. The front surface 202 and the faceplate 200 may include complementary structures to assist in the alignment process. Referring to FIG. 10B, the faceplate 200 may include a projection 254 that can be received in a corresponding indentation 250 of the front surface 202 to provide proper alignment of the face plate 200 on the front surface 202. Each of the holes 214 and 216 may include a shoulder 218 and 220, respectively. The shoulder 218 defines a transition in the hole 214 from a first inner diameter 222 to a second inner diameter 224 that is smaller than the first inner diameter 222. Similarly, the shoulder 220 defines a transition in the hole 214 from a first inner diameter 226 to a second inner diameter 228 that is smaller than the first inner diameter 226.

The club head 102 further includes a first fastener 230 and the second fastener 232 that provide attachment of the faceplate 200 to the club head 102. The first fastener 230 includes a threaded shaft 234 and a fastener head 236 having a larger outer diameter than the outer diameter of the threaded shaft 234. Similarly, the second fastener 232 includes a threaded shaft 238 and a fastener head 240 having a larger outer diameter than the outer diameter of the threaded shaft 238. The outer diameter of the threaded shaft 234 is smaller than any inner diameter of the hole 214 of the faceplate 200 so as to be capable of being inserted through the hole 214. Similarly, the outer diameter of the threaded shaft 238 is smaller than any inner diameter of the hole 216 of the faceplate 200 so as to be capable of being inserted through the hole 216.

The faceplate 200 may be aligned with the front surface 202 so that the holes 214 and 216 generally align with the threaded holes 204 and 206, respectively. The first fastener 230 may then be inserted into the hole 214 such that the threaded shaft 234 engages the threaded hole 204. Rotation of the first fastener 230 causes the threaded shaft 234 to be engaged deeper into the threaded hole 204. The outer diameter of the fastener head 236 may be smaller than the first inner diameter 222 of the hole 214 of the faceplate 200, but larger than the second inner diameter 224 of the hole 214 of the faceplate 200. Accordingly, when the first fastener 230 is being tightened, the fastener head 236 engages the shoulder 218 to press the faceplate 200 against the front surface 202 to attach the faceplate 200 to the club head 102. The fastener head 236 may be sized to be located inside the hole 214 after being tightened such that no part of the fastener head 236 protrudes out of the hole 214. However, the fastener head 236 may be visible to an individual viewing the faceplate 200 when directly viewing the faceplate or viewing from the address position. In other examples, a portion of all of the fastener head 236 may protrude from the hole 214. In other examples, the fastener head 236 may not be visible to an individual viewing the faceplate 200 when directly viewing the faceplate or viewing the faceplate from the address position.

The second fastener 232 may then be inserted into the hole 216 of the faceplate 200 such that the threaded shaft 238 engages the threaded hole 206. Rotation of the second fastener 232 causes the threaded shaft 238 to be engaged deeper into the threaded hole 206. The outer diameter of the fastener head 240 may be smaller than the first inner diameter 226 of the hole 216 of the faceplate 200, but larger than the second inner diameter 228. Accordingly, when the second fastener 232 is being tightened, the fastener head 240 engages the shoulder 220 to press the faceplate 200 against the front surface 202 to attach the faceplate 200 to the club head 102. The fastener head 240 may be sized to be located inside the hole 216 after being tightened such that no part of the fastener head 240 protrudes out of the hole 216. However, the fastener head 240 may be visible to an individual viewing the faceplate 200 when directly viewing the faceplate or viewing from the address position. In other examples, a portion or all of the fastener head 240 may protrude from the hole 216. In other examples, the fastener head 240 may not be visible to an individual viewing the faceplate 200 when directly viewing the faceplate or viewing from the address position. The above-described order of fastening the first fastener 230 and the second fastener 232 is exemplary. Accordingly, the second fastener 232 may be engaged with the threaded hole 206 and tightened in the threaded hole 206 before the first fastener 230 is engaged with the threaded hole 204 and tightened in the threaded hole 204.

A tool (not shown) may be provided for removing the fasteners 230 and 232 from the threaded holes 204 and 206, respectively. The fastener heads 236 and 240 may be shaped similar to the heads of commonly used bolts or screws, such as hex bolts, Torx® bolts, or Phillips head screws, etc. Accordingly, commonly used tools such as a hex wrench, a Torx® wrench, or a Phillips head screwdriver may be used to remove the fasteners 230 and 232 from the threaded holes 204 and 206. According to another example, the fastener heads 236 and 240 may have a uncommon shape so that only a correspondingly compatible tool may be used to operate the fasteners 236 and 240.

The fasteners 230 and 232 are screwed into the holes 204 and 206 to attach the faceplate 200 to the club head 102. However, any type of fastening device may be used to attach the faceplate 200 to the club head 102. The club head 102 may include one or more fastener ports such as holes that may be threaded, smooth, textured, or slotted, etc.; or slots, slits, passages or the like for receiving correspondingly shaped fasteners that provide secure attachment of a faceplate 200 to the club head 102. The fasteners may be have threaded shafts, smooth or textured shafts for frictional engagement with a fastener port on the club head 102, or shafts that have certain structures that provide engagement with corresponding structures of the fastener ports to provide secure attachment of the faceplate 200 to the club head 102. For example, each fastener may include a locking tab that engages a corresponding locking receiver in the club head 102. Release of each fastener may be performed by releasing the locking tab from the locking receiver.

According to the above-described examples, the threaded holes 204 and 206 may be similar, and the fasteners 230 and 232 may be similar. Accordingly, each of the fasteners 230 and 232 may be interchangeably used in any of the threaded holes 204 and 206. However, according to another example, the threaded holes 204 and 206 may be different. For example, the threaded holes 204 and 206 may have different inner diameters and/or thread shapes. Accordingly, the fasteners 230 and 232 may also be different such that fastener 230 can only engage in the threaded hole 204 and the fastener 232 only engage in the threaded hole 206 so that the fasteners 230 and 232 cannot be interchangeably used. While the above examples may describe two fasteners, the apparatus, methods, and articles of manufacture described herein may include more fasteners.

As described herein, the faceplate 200 is removable from the club head 102 and can be exchanged with another faceplate 200 that has different physical and/or material configuration. For example, a faceplate 200 may be removed from the club head 102 and replaced with another faceplate 200 having certain groove configuration, surface texture, and/or material properties that generally affect the movement of a ball differently than the removed faceplate 200. For example, a faceplate 200 having a certain groove configuration may be replaced by a faceplate 200 that has deeper grooves so as to provide an individual with a different ball speed when the faceplate 200 impacts the ball.

Referring to FIGS. 7-9, a plurality of faceplates may be provided such that each of the faceplates is associated with a different loft angle for the golf club head 102. A faceplate 300 may be associated with a loft angle of 3°, a faceplate 302 may be associated with a loft angle of 2°, and a faceplate 304 may be associated with a loft angle of 1°. The loft angle of each faceplate may be defined by a variation in the thickness of each faceplate from the top rail portion 116 to the sole portion 114. As shown by the examples of FIGS. 7-9, an increase in thickness of the faceplate from the top rail thickness 306 to the sole thickness 308 provides a positive loft angle for the golf club head 102. Furthermore, the amount of increase in thickness of a faceplate from the top rail portion 116 to the sole portion 114 may directly correspond to an increase in the loft angle of the golf club head 102. Accordingly, the amount of decrease in thickness of the faceplate from the top rail portion 116 to the sole portion 114 may directly correspond to a decrease in the loft angle for the golf club 102. A faceplate having generally the same thickness from the top rail portion 116 to the sole portion 114 may have a loft angle of 0° if the front surface 202 has forms a loft angle of 0°. The apparatus, methods, and articles of manufacture described herein are not limited in this regard.

The loft angle described herein may represent an absolute loft angle of a faceplate or a loft angle of a faceplate relative to a standard loft angle of the golf club head. An absolute loft angle of the faceplate may represent the angle of the outer surface of the faceplate (i.e., the surface striking a golf ball) relative to a vertical line. A loft angle of the faceplate relative to a standard loft angle may represent an increase or decrease in the loft angle of the faceplate relative to a standard or neutral loft angle. For example, if the front surface 202 has an angle of 0° relative to a vertical line, then a faceplate loft angle of +2° may represent an absolute angle of +2°. In another example, if the front surface 202 has an angle of 2° relative to a vertical line, then a loft angle of +3° for a faceplate may represent an absolute loft angle of +5°. Thus, a loft angle of the faceplate may represent a change in the loft angle of the golf club head from a standard or neutral loft angle, which may have a zero or a non-zero value.

As described herein, an individual may exchange the faceplate 200 on the golf club head 102 with one of a plurality of faceplates 200 to better fit the golf club 100 to his or her current playing style or skill level. For example, an individual may have been previously fitted with a golf club 100 having a 2° loft angle. After a certain period of time, however, the playing style or the skill level of the individual may change such that having a different loft angle on the golf club 100 may improve the performance of the individual. Accordingly, the faceplate 200 on the golf club 100 may be removed and replaced with a faceplate 200 having a different loft angle such as 3° or 1°. In another example, the playing style or skill level of an individual may change such that having a faceplate 200 with different grooves 201 and/or different materials may improve the performance of the individual. Accordingly, the faceplate 200 on the golf club 100 of the individual may be removed and replaced with another faceplate 200 having a different groove configuration and/or materials for providing better performance for the individual.

Each faceplate 200 may include one or more markings that identify one or more configurations of the faceplate. For example, the loft angle of a faceplate 200 may be identified by a certain color, a certain symbol, a general shape of the faceplate, alphanumeric text and/or certain graphics. For example, each faceplate 200 may include a number that is visible to an individual and corresponds to the degrees of loft angle associated with the faceplate 200. In another example, the loft angle of the faceplate 200 may be identified by a portion of the faceplate having a particular color. For example a blue stripe on a certain portion of the faceplate may represent a loft angle of 1°, a green stripe may represent the loft angle of 2°, and a yellow stripe may represent the loft angle of 3°. Other configurations of the faceplate such as groove shapes, groove depths, and groove distribution on the faceplate may be visually identifiable by an individual by a certain color, a certain symbol, a general shape of the faceplate 200, alphanumeric text and/or certain graphics. Similarly, the material of the faceplate 200 may be visually identifiable by an individual by a certain color, a certain symbol, a general shape of the faceplate, alphanumeric text and/or certain graphics. For example, an individual may be able to distinguish between faceplates that are constructed from titanium, aluminum or steel. However, the material of the striking face may also be identified by a certain color, a certain symbol, a general shape of the faceplate, alphanumeric text and/or certain graphics. Any colors, symbols, alphanumeric text and/or graphics may be painted on the faceplate, embossed on the faceplate, provided on a sticker that is attached to the faceplate, or carved or milled on the faceplate. Thus, physical and/or material configuration of each face plate 200 of a plurality of faceplates may be identifiable by an individual by a certain color, a certain symbol, a general shape of the faceplate, alphanumeric text and/or certain graphics.

A heel-to-toe weighting configuration of a golf club may be defined as the variation of the weight of the golf club head from the heel portion 118 to the toe portion 120. According to the disclosure, the heel-to-toe weighting configuration of a golf club may also be changed by using a first fastener 230 that has a different weight than a second fastener 232. For a golf club head 102 having a uniform, balanced, or symmetric weight distribution from the heel portion 118 to the toe portion 120, using a first fastener 230 and a second fastener 232 having the same weight can make the golf club head 102 balanced. For a golf club head 102 having a uniform and/or symmetric weigh distribution form the heel portion 118 to the toe portion 120, the heel-to-toe weighting configuration of the golf club 100 may be biased toward the toe portion 120 when the second fastener 232 is heavier than the first fastener 230. In other words, the center of gravity of the golf club head 102 may be nearer to the toe portion 120 than to the heel portion 118. For a golf club head 102 having a uniform and/or symmetric weigh distribution form the heel portion 118 to the toe portion 120, when the first fastener 230 is heavier than the second fastener 232, the heel-to-toe weighting configuration of the golf club may be biased toward the heel portion 118. In other words, the center of gravity of the golf club head 102 may be nearer to the heel portion 118 than the toe portion 120. Furthermore, increasing or decreasing the difference in weight between the first fastener 230 and the second fastener 232 also increases or decreases, respectively, the weight bias between the heel portion 118 and the toe portion 120. Further yet, the entire weight of a golf club head can be increased or decreased by using fasteners 230 and 232 with higher or lower weights, respectively, as compared to any fastener that may be currently used for the golf club head 102.

As described herein, an individual may exchange any one of the fasteners 230 and 232 on the golf club head 102 with another one or pair of fasteners to better fit the golf club 100 to his or her current playing style or skill level. For example, an individual may have been previously fitted with a golf club 100 having a toe biased heel-to-toe weight configuration. After a certain period of time, however, the playing style or the skill level of the individual may change such that having a different heel-to-toe weight configuration may improve the performance of the individual. Accordingly, one or both of the fasteners 230 and/or 232 may be removed and replaced with fasteners that provide a different heel-to-toe weight configuration. Therefore, an individual may have the option of selecting two fasteners from a plurality of fasteners having the same weights, different weights relative to each other and/or different weights as compared to any fasteners being used on the golf club head 102 to achieve a preferred heel-to-toe weight configuration.

Fasteners as described herein, such as the exemplary fasteners 230 and 232, may have one or more visual indicators that allow an individual to determine the weight of the fasteners 230 and 232 when the fasteners are used to attach a faceplate 200 to the golf club head 102. A fastener as described herein may have a certain color, a certain symbol, a certain shape, alphanumeric text and/or certain graphics that indicate the weight of the fastener or the weight of the fastener relative to other similar fasteners. For example, the head of a fastener may include a certain color that indicates the weight of the fastener. Lighter colors may indicate lighter weight fasteners while darker colors may indicate heavier fasteners. For example, four fasteners progressively increasing in weight in 5 gram increments from 5 grams to 20 grams may have fastener heads that have the colors white, yellow, green and blue, respectively. A chart may be provided to an individual that shows the weight associated with each color. Each fastener may also have the weight of the fastener visually displayed on the fastener head with a number. For example, four fasteners progressively increasing in weight in 5 gram increments from 5 grams to 20 grams may have fastener heads showing the numbers 5, 10, 15 and 20, respectively. Each fastener may also have a different shape to indicate to an individual the weight of the fastener. Any colors, symbols, alphanumeric text and/or graphics may be painted on a fastener, embossed on a fastener, provided on a sticker that is attached to the fastener, or carved or milled on the fastener. Fasteners having different shapes associated with the weights of the fasteners may be manufactured as described herein.

According to one example, the golf club head 102 may include one or more layers between the faceplate 200 and the front surface 202. For example, the golf club head 102 may include an elastomeric layer (not shown) between the faceplate 200 and the front surface 202. Such an elastomeric layer may provide control of vibration, dampening and/or sound of the golf club head 102 when striking a ball depending on the physical and material properties of the elastomeric layer.

Figure 11:
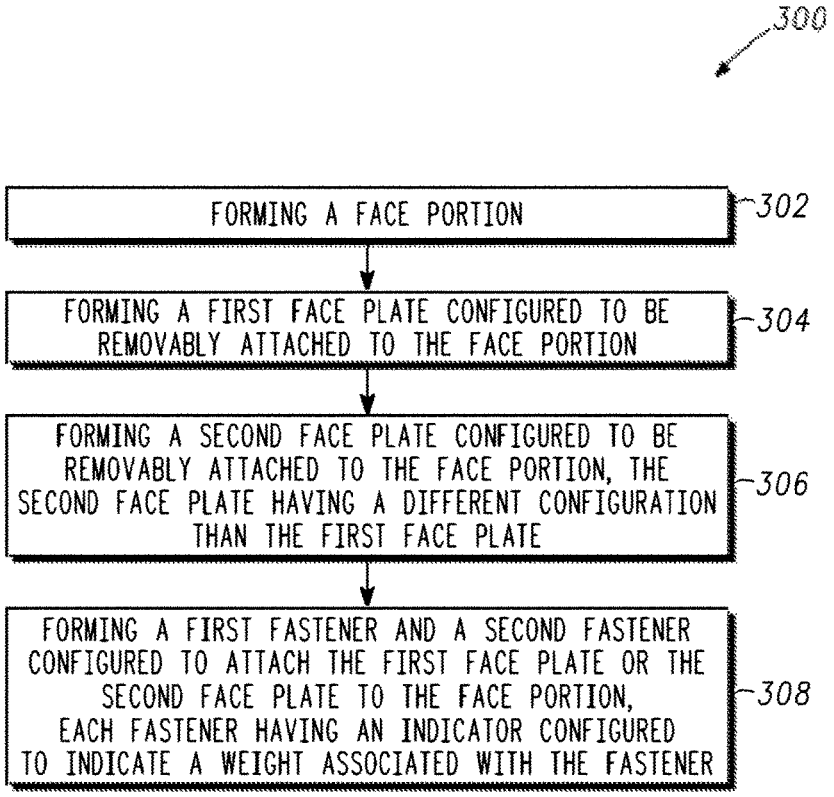
FIG. 11 shows a flow chart of an exemplary method of manufacturing a golf club head according to one embodiment.

Referring to FIG. 11, a method 300 to manufacture a golf club head according to the disclosure is shown. The method 300 includes forming a face portion (block 302) such as the face portion 110, forming a first faceplate (block 304) and forming a second faceplate (block 306), such as the faceplate 200 by any of the methods described herein. The method 300 may also include forming more than two faceplates, from which an individual can select a faceplate to attach to the face portion 110. Each faceplate 200 may be associated with a certain loft angle, be constructed from certain materials that may affect ball movement when a ball is struck with a faceplate, have different groove configurations, or have different characteristics and/or properties that may be different from some or all of the other faceplates 200 of the plurality of faceplates. The method 300 may further include forming a first fastener and a second fastener (block 308) by any of the methods described herein. The first fastener and the second fastener are configured to attached the first faceplate or the second faceplate to the face portion. Each fastener may have an indicator configured to indicate a weight associated with the fastener. The method 300 may include forming more than two fasteners. According to one example, at least three fasteners may be formed, two of which have generally the same weight while the third is lighter or heavier than the other two fasteners. When the two fasteners that have the same weight are used to attach a faceplate 200 to the club head 102, a balanced heel-to-toe weight configuration may be achieved. When two fasteners that have generally dissimilar weights are used to attach the faceplate 200 to the club head 102, either a heel biased heel-to-toe weight configuration or a toe biased heel-to-toe weight configuration may be achieved depending on the locations of the two fasteners.

A golf club head, a faceplate, a fastener and/or any part of the golf club 100 according to the disclosure may be constructed from any type of material, such as stainless steel, aluminum, titanium, various other metals or metal alloys; composite materials such as Kevlar®, graphite and/or fiberglass; natural materials such as wood or stone; artificial materials such as plastic; and/or a combination of different materials. A golf club head, a faceplate, a fastener and/or any part of the golf club 100 according to the disclosure may be constructed by stamping (i.e., punching using a machine press or a stamping press, blanking, embossing, bending, flanging, or coining, casting), injection molding, forging, machining or a combination thereof, or other processes used for manufacturing metal, composite, plastic or wood parts. For example, a faceplate constructed from graphite may be formed by a sheet lamination process, filament winding process or resin transfer molding process. Any of the disclosed threaded or unthreaded holes, slits, slots, and/or grooves may be manufactured after manufacturing the part that includes the threaded or unthreaded holes, slits, slots, and/or grooves by stamping (i.e., punching using a machine press or a stamping press, blanking, embossing, bending, flanging, or coining, casting), machining or a combination thereof, or other processes used for manufacturing metal, composite, plastic or wood parts. Alternatively, any of the disclosed threaded or unthreaded holes, slits, slots, and/or grooves may be manufactured with the part that includes the threaded or unthreaded holes, slits, slots, and/or grooves.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

Although certain example methods, apparatus, systems, and articles of manufacture have been described herein, the scope of coverage of this disclosure is not limited thereto. On the contrary, this disclosure covers all methods, apparatus, systems, and articles of manufacture fairly falling within the scope of the appended claims either literally or under the doctrine of equivalents.

What is claimed is:

1. A golf club head comprising:

a face portion, a back portion, a sole portion, a top rail portion, a heel portion and a toe portion;

wherein the face portion is configured to have a toe side blind receiving hole and a heel side blind receiving hole;

wherein the face portion comprises a generally flat front surface;

wherein the face portion also consists of a single indentation generally in a center position, and except for the single indentation, the flat front surface of the face portion spans uninterrupted from the top rail portion to the sole portion and from the toe side blind receiving hole to the heel side blind receiving hole;

wherein the face portion, the back portion, the sole portion, the top rail portion, the heel portion, and the toe portion are an integral, single piece;

a first faceplate configured to be removably attached to the face portion;

a second faceplate configured to be removably attached to the face portion, the second face plate having a different configuration than the first faceplate; and a first fastener and a second fastener configured to attach the first faceplate or the second faceplate to the face portion, each fastener having an indicator configured to indicate a weight associated with the fastener;

wherein the first faceplate is configured to include a first toe side hole that extends through a thickness of the first faceplate and a second heel side hole that extends through the thickness of the first faceplate, and the second faceplate is configured to include a first toe side hole that extends through a thickness of the second faceplate and a second heel side hole that extends through the thickness of the second faceplate, and, wherein the first faceplate and the second faceplate each consist of a single projection on a rear surface that inserts into the single indentation of the face portion to properly align the first or second faceplate on the face portion, and wherein the first fastener is inserted through the first toe side hole of the first or second faceplate into the toe side blind receiving hole in the face portion, and the second fastener is inserted through the second heel side hole of the first or second faceplate into the heel side blind receiving hole in the face portion to attach the first faceplate or the second faceplate to the face portion, wherein the first faceplate or the second faceplate cover the profile of the face portion of the golf club head.

2. The golf club head as defined in claim 1, wherein the indicator is visible when the first faceplate or the second faceplate is attached to the face portion.

3. The golf club head as defined in claim 1, wherein when the second faceplate is attached to the face portion, the face portion has a loft angle that is different from a loft angle of the face portion when the first faceplate is attached to the face portion.

4. The golf club head as defined in claim 1, wherein the first faceplate and the second faceplate are at least partially constructed from a different material.

5. The golf club head as defined in claim 1, wherein the first faceplate comprises grooves on a ball striking side of the first faceplate, wherein the second faceplate comprises grooves on a ball striking side of the second faceplate, and wherein the grooves of the first faceplate have a different configuration than the grooves of the second faceplate.

6. The golf club head as defined in claim 1 further comprising at least one of:

the first fastener having a greater weight than the second fastener;

the first fastener having a lower weight than the second fastener; or the first fastener and the second fastener having substantially a same weight.

7. The golf club head as defined in claim 1, wherein each of the first faceplate and the second faceplate comprises:

a front side configured to strike a ball, a back side configured to face the face portion, a top rail portion and a sole portion;

wherein a thickness of the first faceplate or the second faceplate is defined by the distance between the front side and the back side; and wherein a change in thickness from the top rail portion to the sole portion defines a loft angle associated with the first faceplate or the second faceplate.

8. The golf club head as defined in claim 1, further comprising:

an elastomeric layer;

wherein:

each of the first faceplate and the second faceplate further comprises a ball striking side and a faceplate rear surface opposite the ball striking side;

when the first faceplate is attached to the face portion, the elastomeric layer is between the front surface of the face portion and the faceplate rear surface of the first faceplate; and when the second faceplate is attached to the face portion, the elastomeric layer is between the front surface of the face portion and the faceplate rear surface of the second faceplate.

9. The golf club head as defined in claim 1, wherein:

each of the first faceplate and the second faceplate further comprises a ball striking side and a faceplate rear surface opposite the ball striking side;

when the first faceplate is attached to the face portion, no cavity is formed between the rear surface of the first faceplate and the front surface of the face portion; and when the second faceplate is attached to the face portion, no cavity is formed between the rear surface of the second faceplate and the front surface of the face portion.

10. A golf club head comprising:

a face portion, a back portion, a sole portion, a top rail portion, a heel portion and a toe portion;

wherein a heel fastener port and a toe fastener port are blind holes in the face portion;

wherein the face portion comprises a generally flat front surface;

wherein the face portion also consists of a single indentation generally in a center position, and except for the single indentation, the flat front surface of the face portion spans uninterrupted from the top rail portion to the sole portion and from the toe fastener port to the heel fastener port;

wherein the face portion, the back portion, the sole portion, the top rail portion, the heel portion, and the toe portion are an integral, single piece;

a plurality of interchangeable faceplates configured to be removably attached to the face portion;

wherein each faceplate of the plurality of faceplates comprising a heel portion, a toe portion, a heel hole on or proximate to the heel portion, and a toe hole on or proximate to the toe portion;

wherein each faceplate consists of a single projection on a rear surface that inserts into the single indentation of the face portion to properly align each faceplate on the face portion, and a plurality of fasteners, each fastener configured to interchangeably engage between each faceplate and the heel fastener port or the toe fastener port to attach each faceplate to the face portion, at least two of the plurality of fasteners having the same weight and at least two of the plurality of the fasteners having a different weight to adjust a weight configuration between the heel portion and the toe portion;

wherein each fastener of the plurality of fasteners comprises a shaft portion and a head portion, the shaft portion configured to traverse through the heel hole or the toe hole of any of the faceplates of the plurality of faceplates and engage the heel fastener port or the toe fastener port of the face portion to at least partially attach the faceplate to the face portion, wherein a first faceplate or a second faceplate cover a profile of the face portion of the golf club head.

11. The golf club head as defined in claim 10, wherein when each faceplate of the plurality of the faceplates is attached to the face portion, the face portion has a loft angle that is different from a loft angle of the face portion when another one of the plurality of faceplates is attached to the face portion.

12. The golf club head as defined in claim 10, wherein at least two of the faceplates of the plurality of faceplates are at least partially constructed from a different material.

13. The golf club head as defined in claim 10, wherein a first faceplate of the plurality of faceplates comprises grooves on a ball striking side of the first faceplate, wherein a second faceplate of the plurality of faceplates comprises grooves on a ball striking side of the second faceplate, and wherein the grooves of the first faceplate have a different configuration than the grooves of the second faceplate.

14. The golf club head as defined in claim 10, wherein a difference in weight between a pair of fasteners of the plurality of fasteners used to attach a faceplate of the plurality of faceplates to the face portion is visually identifiable when the faceplate is attached to the face portion.

15. The golf club head as defined in claim 10, wherein each of the faceplates of the plurality of faceplates comprises:

a front side configured to strike a ball, a back side configured to face the face portion, a top rail portion and a sole portion;

wherein a thickness of each faceplate of the plurality of faceplates is defined by a distance between the front side and the back side; and wherein a change in thickness from the top rail portion to the sole portion defines a loft angle associated with each faceplate of the plurality of faceplates.

16. A method of manufacturing a golf club head comprising:

forming a face portion, a back portion, a sole portion, a top rail portion, a heel portion and a toe portion;

wherein the face portion is configured to have a toe side blind receiving hole and a heel side blind receiving hole;

wherein forming the face portion comprises forming a generally flat front surface;

wherein the face portion also consists of a single indentation generally in a center position, and except for the single indentation, the flat front surface of the face portion spans uninterrupted from the top rail portion to the sole portion and from the toe side blind receiving hole to the heel side blind receiving hole;

forming the face portion, the back portion, the sole portion, the top rail portion, the heel portion, and the toe portion as an integral, single piece;

forming a first faceplate configured to be removably attached to the face portion;

forming a second faceplate configured to be removably attached to the face portion, the second face plate having a different configuration than the first faceplate;

wherein the first faceplate is configured to include a first toe side hole that extends through a thickness of the first faceplate and a second heel side hole that extends through the thickness of the first faceplate, and, wherein the first faceplate and the second faceplate each consist of a single projection on a rear surface that inserts into the single indentation of the face portion to properly align the first or second faceplate on the face portion, and forming a first fastener and a second fastener configured to attach the first faceplate or the second faceplate to the face portion, each fastener having an indicator configured to indicate a weight associated with the fastener;

wherein the first fastener is inserted through the first toe side hole of the first or second faceplate into the toe side blind receiving hole in the face portion and the second fastener is inserted through the second heel side hole of the first or second faceplate into the heel side blind receiving hole in the face portion to attach the first faceplate or the second faceplate to the face portion, wherein the first faceplate or the second faceplate cover a profile of the face portion of the golf club head.

17. The method as defined in claim 16, further comprising forming the first face plate and the second faceplate such that when the second faceplate is attached to the face portion, the face portion has a loft angle that is different from a loft angle of the face portion when the first faceplate is attached to the face portion.

18. The method as defined in claim 16, further comprising forming the first faceplate and the second faceplate at least partially from a different material.

19. The method as defined in claim 16, further comprising forming grooves on a ball striking side of the first faceplate and forming grooves on a ball striking side of the second faceplate such that the grooves of the first faceplate have a different configuration than the grooves of the second faceplate.

20. The method as defined in claim 16, further comprising at least one of:

forming the first fastener to have a greater weight than the second fastener;

forming the first fastener to have a lower weight than the second fastener; or forming the first fastener and the second fastener to have substantially a same weight.

21. The method as defined in claim 16, further comprising: forming the face portion to further comprise a heel portion, a toe portion, a heel fastener port on or proximate to the heel portion, and a toe fastener port on or proximate to the toe portion;

forming each of the first faceplate and the second faceplate to further comprising a heel portion, a toe portion, a heel hole on or proximate to the heel portion, and a toe hole on or proximate to the toe portion;

forming each of the first fastener and the second fastener to further comprise a shaft portion and a head portion, the shaft portion configured to traverse through the heel hole or the toe hole of the first faceplate or the second faceplate and engage the heel fastener port or the toe fastener port of the face portion to at least partially attach the first faceplate or the second faceplate to the face portion, wherein the head portion, the heel hole and the toe hole are configured such that the head portion is visible from the heel hole or the toe hole when a shaft is engaged to the heel fastener port or the toe fastener port.

22. The method as defined in claim 16, wherein forming each of the first faceplate and the second faceplate to further comprise:

a front side configured to strike a ball, a back side configured to face the face portion, a top rail portion and a sole portion;

wherein a thickness of the first faceplate or the second faceplate is defined by a distance between the front side and the back side; and wherein a change in thickness from the top rail portion to the sole portion defines a loft angle associated with the first faceplate or the second faceplate.

* * * * *